US009841713B2

(12) United States Patent
Murase et al.

(10) Patent No.: US 9,841,713 B2
(45) Date of Patent: Dec. 12, 2017

(54) FIXING DEVICE AND IMAGE FORMING APPARATUS

(71) Applicant: FUJI XEROX CO., LTD., Tokyo (JP)

(72) Inventors: Hisashi Murase, Ebina (JP); Jumpei Amano, Ebina (JP); Tsuyoshi Sunohara, Ebina (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/254,032

(22) Filed: Sep. 1, 2016

(65) Prior Publication Data

US 2017/0261898 A1 Sep. 14, 2017

(30) Foreign Application Priority Data

Mar. 9, 2016 (JP) ..... 2016-045682

(51) Int. Cl.
*G03G 15/20* (2006.01)

(52) U.S. Cl.
CPC ..... *G03G 15/2053* (2013.01)

(58) Field of Classification Search
CPC ..... G03G 15/2075; G03G 15/2025
See application file for complete search history.

(56) References Cited

U.S. PATENT DOCUMENTS

2009/0263171 A1 10/2009 Kageyama
2011/0135353 A1* 6/2011 Creteau ..... G03G 15/2025 399/329
2013/0195523 A1* 8/2013 Yamaji ..... G03G 15/2053 399/329
2014/0286685 A1* 9/2014 Ishida ..... G03G 15/2025 399/329
2016/0097997 A1* 4/2016 Miyauchi ..... G03G 15/2053 399/325
2016/0349681 A1* 12/2016 Miyauchi ..... G03G 15/2053

FOREIGN PATENT DOCUMENTS

JP 2009-259714 A 11/2009
JP 2009-300862 A 12/2009
JP 2015121745 A * 7/2015

* cited by examiner

*Primary Examiner* — Sevan A Aydin
(74) *Attorney, Agent, or Firm* — Oliff PLC

(57) ABSTRACT

There is provided a fixing device. An endless fixing belt has an inner circumferential surface to which lubricant is applied and that is rotated. A first plate-shaped body is disposed along the inner circumferential surface and is in contact with the inner circumferential surface. A second plate-shaped body is disposed along the first plate-shaped body at a distance to cause a capillary phenomenon in the lubricant. A bent portion is provided in an end portion of the second plate-shaped body in a rotating direction of the fixing belt and is bent on an inner circumferential surface side on a downstream side of an end portion of the first plate-shaped body in the rotating direction of the fixing belt.

5 Claims, 7 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2016-045682 filed Mar. 9, 2016.

TECHNICAL FIELD

The present invention relates to a fixing device where lubricant is applied to an inner circumferential surface of a fixing belt and an image forming apparatus.

SUMMARY

According to an aspect of the embodiments of the present invention, there is provided a fixing device comprising: an endless fixing belt that has an inner circumferential surface to which lubricant is applied and that is rotated; a first plate-shaped body that is disposed along the inner circumferential surface and is in contact with the inner circumferential surface; a second plate-shaped body that is disposed along the first plate-shaped body at a distance to cause a capillary phenomenon in the lubricant; and a bent portion that is provided in an end portion of the second plate-shaped body in a rotating direction of the fixing belt and is bent on an inner circumferential surface side on a downstream side of an end portion of the first plate-shaped body in the rotating direction of the fixing belt.

BRIEF DESCRIPTION OF THE DRAWINGS

Exemplary embodiments of the present invention will be described in detailed based on the following figures, wherein.

DETAILED DESCRIPTION

First Exemplary Embodiment

Figure 1:
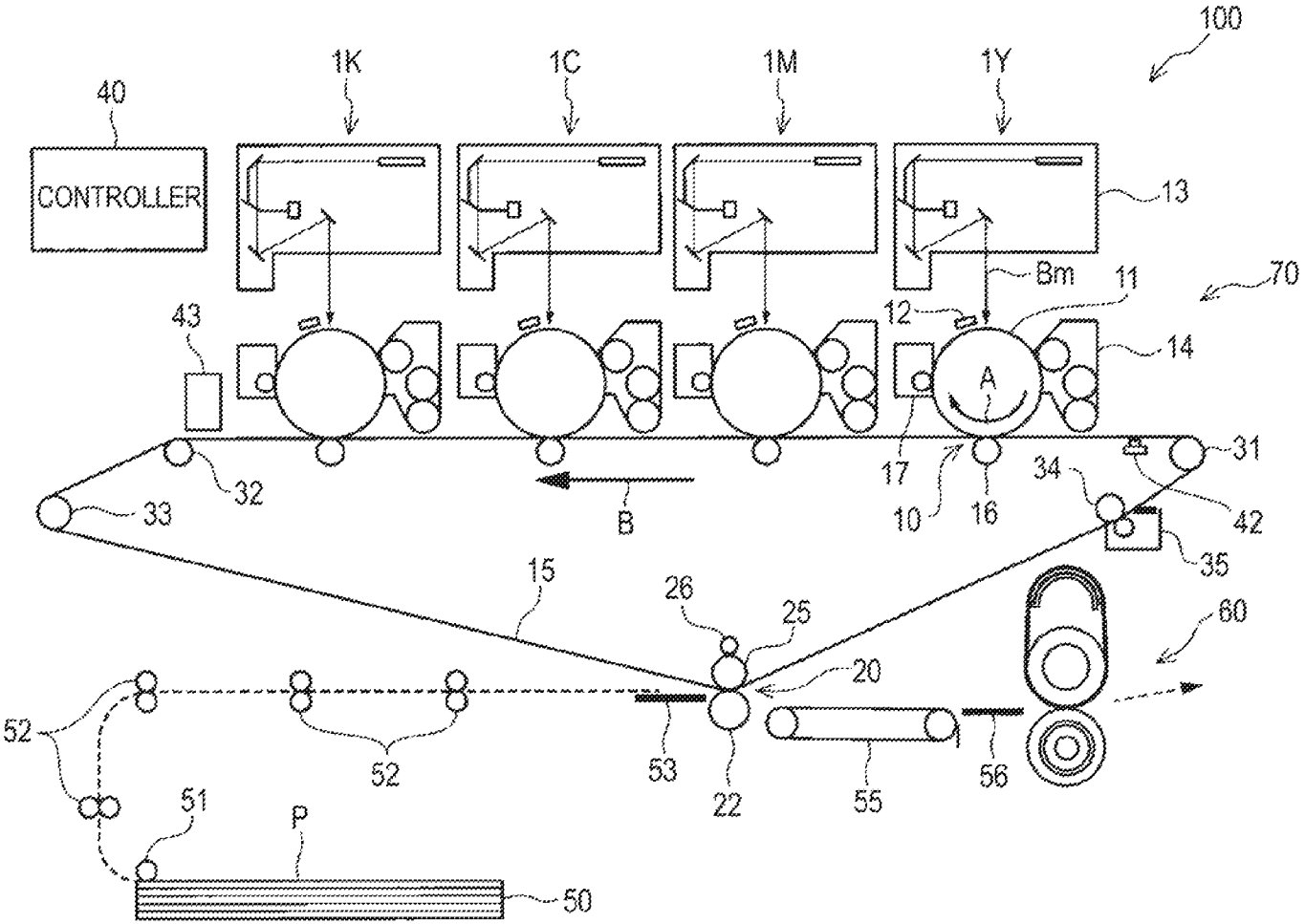
FIG. 1 is a schematic configuration diagram illustrating an image forming apparatus according to a first exemplary embodiment.

Hereinafter, a first exemplary embodiment of the present invention will be described with reference to the drawings. FIG. 1 is a schematic configuration diagram illustrating an image forming apparatus 100 according to the first exemplary embodiment. The image forming apparatus 100 configures a printer of an intermediate transfer system as an example.

The image forming apparatus 100 includes plural image forming units 1Y, 1M, 1C, and 1K that form respective toner images of color components by an electrophotographic system, a primary transfer portion 10 that causes the toner image of each color component formed by each of the image forming units 1Y, 1M, 1C, and 1K to sequentially transfer (primarily transfer) to an intermediate transfer belt 15, a secondary transfer portion 20 that causes superimposed toner images transferred on the intermediate transfer belt 15 to collectively transfer (secondarily transfer) on a medium P, and a fixing device 60 that fixes the image that is secondarily transferred on the medium P. The image forming apparatus 100 also includes a controller 40 that controls an operation of each portion of each device. Here, a combination of the image forming units 1Y, 1M, 1C, and 1K, the intermediate transfer belt 15, the primary transfer portion 10, and the secondary transfer portion 20 corresponds to an example of an image forming portion 70 that is referred to in the exemplary embodiment.

The image forming apparatus 100 is a so-called tandem type printer and the image forming units 1Y, 1M, 1C, and 1K are configured such that yellow (Y), magenta (M), cyan (C), and black (K) are arranged in parallel from an upstream side of the intermediate transfer belt 15. The image forming units 1Y, 1M, 1C, and 1K have the same configuration as each other except that colors of toners to be used are different.

If a representative color to the image forming unit 1Y corresponding to yellow is described with reference to numerals, the image forming unit 1Y has a photoconductor drum 11 that is rotated in a direction of arrow A, a charger 12 that charges the photoconductor drum 11, a laser exposure device 13 that writes an electrostatic latent image by applying an exposure beam Bm to the photoconductor drum 11, a developing device 14 in which toner of yellow is stored and which develops the electrostatic latent image on the photoconductor drum 11 using the toner, the primary transfer portion 10 that transfers the toner image of each color component formed on the photoconductor drum 11 to the intermediate transfer belt 15, and a toner cleaner 17 that removes residual toner on the photoconductor drum 11.

The intermediate transfer belt 15 is, for example, a film-like endless belt that is formed by a material obtained by containing an antistatic agent in resin. The intermediate transfer belt 15 is bridged between the plural rolls and circulates in a B direction illustrated in FIG. 1. The rolls on which the intermediate transfer belt 15 is bridged are a driving roll 31 that drives the intermediate transfer belt, a support roll 32 that supports both ends of a region in which the intermediate transfer belt 15 is extended along the arrangement of the photoconductor drums 11, a tension roll 33 that applies a constant tension to the intermediate transfer belt 15, a rear roll 25 that is provided in the secondary transfer portion, and a cleaning portion rear roll 34 that is provided in the cleaning portion. The driving roll 31 is driven by a motor (not illustrated) and causes the intermediate transfer belt 15 to circulate at a predetermined speed. The tension roll 33 also functions as a correction roll for preventing meandering of the intermediate transfer belt 15.

The primary transfer portion 10 has a primary transfer roll 16 that is disposed to face the photoconductor drum 11 where the intermediate transfer belt 15 is interposed therebetween. The intermediate transfer belt 15 is clamped between the primary transfer roll 16 and the photoconductor drum 11. A voltage (primary transfer bias) of a polarity opposite to a charge polarity (negative polarity in the exemplary embodiment and hereinafter, the same) of the toner is applied to the primary transfer roll 16.

The secondary transfer portion 20 includes a secondary transfer roll 22 that is disposed on a toner image holding surface side of the intermediate transfer belt 15, a rear roll 25, and a power feeding roll 26 that applies a secondary transfer bias to the rear roll 25. The rear roll 25 is disposed on an inner circumferential surface of the intermediate transfer belt 15, that is, on a side opposite to the secondary transfer roll 22 where the intermediate transfer belt 15 is interposed therebetween, and forms a counter electrode of the secondary transfer roll 22. In addition, an image density sensor 43 is disposed on a downstream side from the image forming unit 1K of black to perform adjustment of image quality.

In addition, an intermediate transfer belt cleaner 35 is provided on the downstream side from the secondary transfer portion 20 of the intermediate transfer belt 15 for cleaning the surface of the intermediate transfer belt 15 by removing residual toner or paper dust on the intermediate transfer belt 15 after the secondary transfer. On the other hand, a reference sensor (home position sensor) 42 is disposed on an upstream side from the image forming unit 1Y of yellow to generate a reference signal for taking an image formation timing in each of the image forming units 1Y, 1M, 1C, and 1K.

Furthermore, the image forming apparatus 100 includes a sheet accommodating portion 50 that accommodates the sheet P, a pickup roll 51 that delivers the medium P integrated in the sheet accommodating portion 50, a transport roll 52 that transports the medium P, a guide member 53 that guides the medium P transported by the transport roll 52 to the secondary transfer portion 20, a transport belt 55 that transports the medium P to the fixing device 60 after the medium P is secondarily transferred by the secondary transfer roll 22, and a fixing entry guide 56 that guides the medium P to the fixing device 60 as a sheet transport system.

Next, a basic process of the image forming portion 70 will be described.

After performing image processing on image data output from an image reading device or a personal computer (PC) (not illustrated), the image forming portion 70 converts the image data into color material tone data of four colors of Y, M, C, and K, and supplies the color material tone data on the laser exposure devices 13 of the image forming units 1Y, 1M, 1C, and 1K. The laser exposure device 13 applies the exposure beam Bm emitted, for example, from a semiconductor laser to the photoconductor drum 11 of each of the image forming units 1Y, 1M, 1C, and 1K in accordance with the supplied color material tone data. After a surface of the photoconductor drum 11 of each of the image forming units 1Y, 1M, 1C, and 1K is charged by the charger 12, the surface is scanned and exposed by the laser exposure device 13 and the electrostatic latent image is formed on the photoconductor drum 11. The formed electrostatic latent image is developed as the toner image of each color of Y, M, C, and K by the developing device 14 of each of the image forming units 1Y. 1M, 1C, and 1K.

The toner images formed on the photoconductor drums 11 of the image forming units 1Y, 1M, 1C, and 1K are transferred to be sequentially superimposed on the surface of the intermediate transfer belt 15 in the primary transfer portion 10. After the toner images are sequentially transferred on the surface of the intermediate transfer belt 15, the toner images are transported to the secondary transfer portion 20 in accordance with the movement of the intermediate transfer belt 15. On the other hand, in the sheet transport system, the pickup roll 51 delivers the recording medium P accommodated in the sheet accommodating portion in accordance with timing when the toner image is transported to the secondary transfer portion 20. The medium P that is delivered by the pickup roll 51 is transported by the transport roll 52 and reaches the secondary transfer portion 20 in accordance with moving timing of the intermediate transfer belt 15 in which the toner image is held.

The secondary transfer portion 20 transfers the toner image held on the intermediate transfer belt 15 on the medium P that is clamped between the intermediate transfer belt 15 and the secondary transfer roll 22. The medium P to which the toner image is electrostatically transferred is transported to the fixing device 60 by the transport belt 55. The fixing device 60 adds heat and pressure to the toner image on the medium P and fixes the toner image on the medium P. The medium P on which a fixed image is formed is discharged to an ejection portion (not illustrated).

On the other hand, residual toner remaining on the intermediate transfer belt 15 without being transferred from the intermediate transfer belt 15 to the medium P by the secondary transfer portion 20 is removed from the intermediate transfer belt 15 by the intermediate transfer belt cleaner 35.

[Fixing Device]

Figure 2:
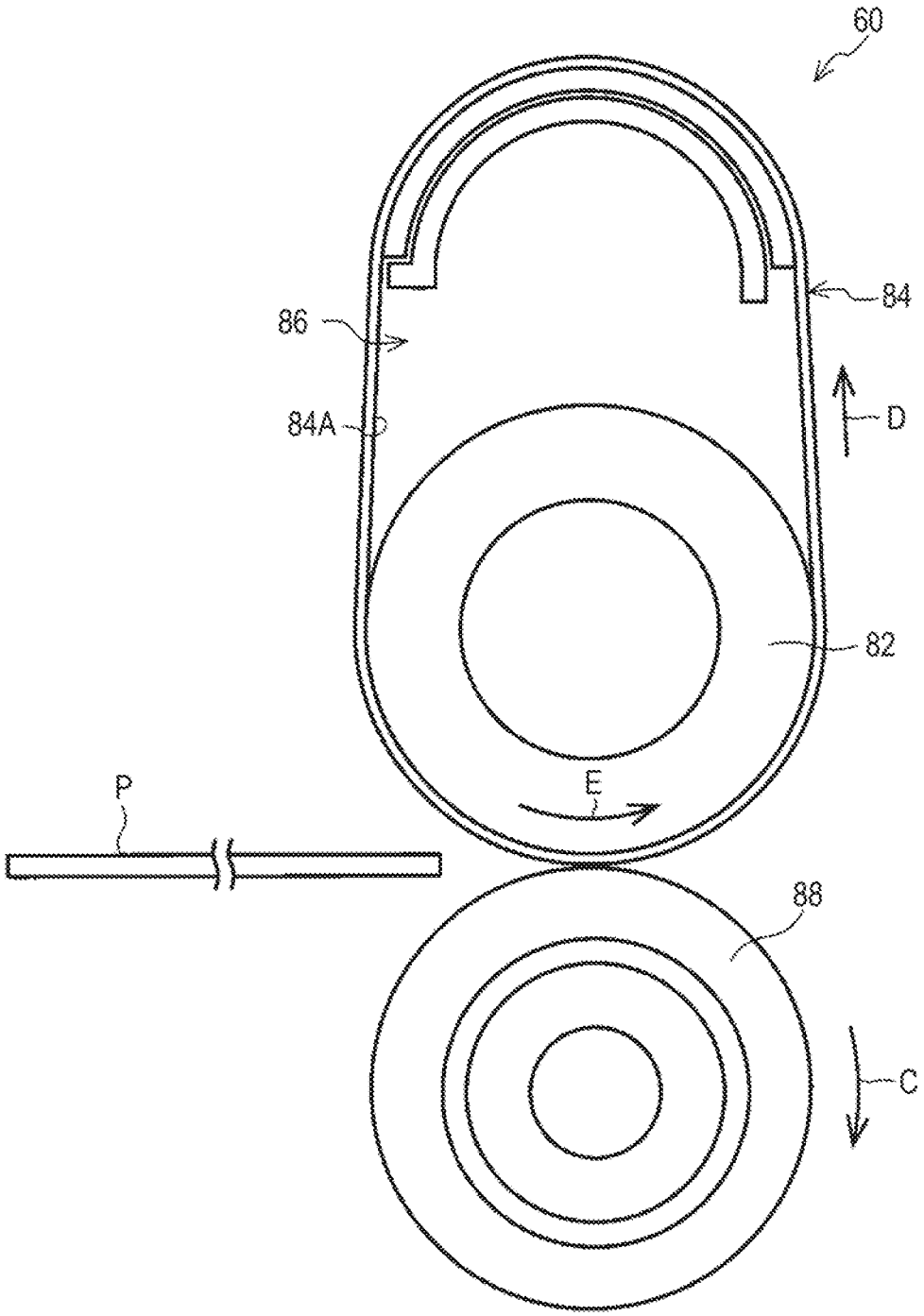
FIG. 2 is a sectional view illustrating a configuration of a fixing device illustrated in FIG. 1.

Hereinafter, the fixing device 60 configuring the image forming apparatus 100 will be described. As illustrated in FIG. 2, the fixing device 60 is configured to include a fixing roll 82, a fixing belt 84, a heating member 86, and a pressurizing roll 88.

The fixing belt 84 is an endless band-shaped belt in a direction of circulation and is bridged between the fixing roll 82 and the heating member 86. Outer circumferential surfaces of the fixing belt 84 and the pressurizing roll 88 are in contact with each other and the fixing belt 84 circulates in a belt rotating direction D in accordance with the rotation of the pressurizing roll 88 in a rotating direction C. Therefore, the fixing roll 82 is also rotated in a rotating direction E.

The fixing belt 84 is disposed to be pressed relative to the pressurizing roll 88. The medium P is supplied on a nip portion formed between the fixing belt 84 and the pressurizing roll 88 via the fixing entry guide 56 (see FIG. 1). Moreover, the supplied medium P is not limited to the sheet and may be, for example, a sheet such as a resin film.

Figure 3:
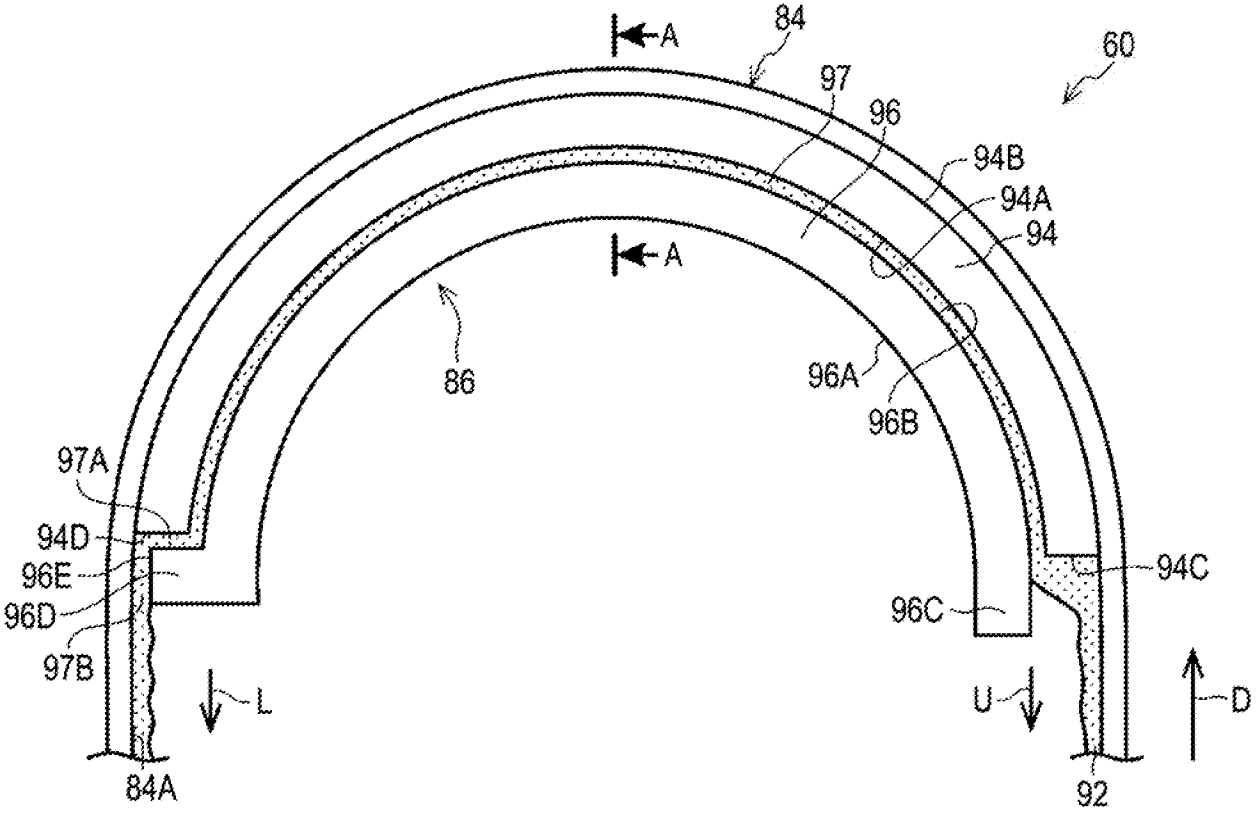
FIG. 3 is an enlarged view illustrating a main portion of FIG. 2.

As illustrated in FIG. 3, a lubricant 92 is applied to an inner circumferential surface 84A of the fixing belt 84 and friction between the fixing belt 84 and the heating member 86 is suppressed. As the lubricant 92, silicone oil is used, but other types of lubricant such as grease that is not a liquid lubricating agent at room temperature may be used.

As illustrated in FIG. 3, the heating member 86 is a member to heat the fixing belt 84 to a predetermined temperature by being in contact with the inner circumferential surface 84A of the fixing belt 84. The heating member 86 heats the fixing belt 84, for example, to 200° C. or less. Therefore, as illustrated in FIG. 2, the medium P is clamped between the heated fixing belt 84 and the pressurizing roll 88 and is heated and pressed. The unfixed toner image is heated and melted by the fixing belt 84, and then is fixed on the medium P.

The heating member 86 includes a first plate-shaped body 94 that is disposed along the inner circumferential surface 84A of the fixing belt 84 and a second plate-shaped body 96 that is disposed along the first plate-shaped body 94. Both end portions of the first plate-shaped body 94 and the second plate-shaped body 96 in a width direction are supported on a housing. A gap 97, which is set to an interval to cause a capillary phenomenon in the lubricant 92, is formed between an inner surface 94A of the first plate-shaped body 94 and an external surface 96B of the second plate-shaped body 96 from an end portion on an upstream side U to an end portion of a downstream side L.

The first plate-shaped body 94 is formed to have an arc-shaped cross section and a width dimension being in contact with the entire region of the fixing belt 84 in the width direction. The first plate-shaped body 94 includes a planar heat generating element and an external surface 94B of the first plate-shaped body 94 is in contact with the inner circumferential surface 84A of the fixing belt 84. Therefore, the fixing belt 84 is heated from the inside.

The second plate-shaped body 96 is also formed to have an arc-shape in a cross section and the same width dimension as that of the first plate-shaped body 94. The second plate-shaped body 96 has a function of homogenizing temperature distribution in the width direction when being heated in the first plate-shaped body 94 and the second plate-shaped body 96 is made of metal such as aluminum having high thermal conductivity.

A tip portion of the second plate-shaped body 96 on the upstream side U in the belt rotating direction D is extended outward on the upstream side U from a tip 94C of the first plate-shaped body 94 on the upstream side U. An extended-out portion 96C is formed by the tip portion.

After a base end portion of the second plate-shaped body 96 on the downstream side L in the belt rotating direction D is extended outward on the downstream side L from the first plate-shaped body 94, the base end portion is bent on the inner circumferential surface 84A of the fixing belt 84. Therefore, a bent portion 96D, which is bent on the inner circumferential surface 84A side of the fixing belt 84 on the downstream side L from a base end 94D of the first plate-shaped body 94, is formed in the base end portion of the second plate-shaped body 96.

A gap 97A is formed between the bent portion 96D and the base end 94D of the first plate-shaped body 94, and dimensions of the gap 97A are set to substantially the same dimensions as those of the gap 97 between the first plate-shaped body 94 and the second plate-shaped body 96. In addition, a gap 97B is also formed between a tip 96E of the bent portion 96D and the inner circumferential surface 84A of the fixing belt 84. Dimensions of the gap 97B are also set to substantially the same dimensions as those of the gap 97 between the first plate-shaped body 94 and the second plate-shaped body 96.

Figure 4:
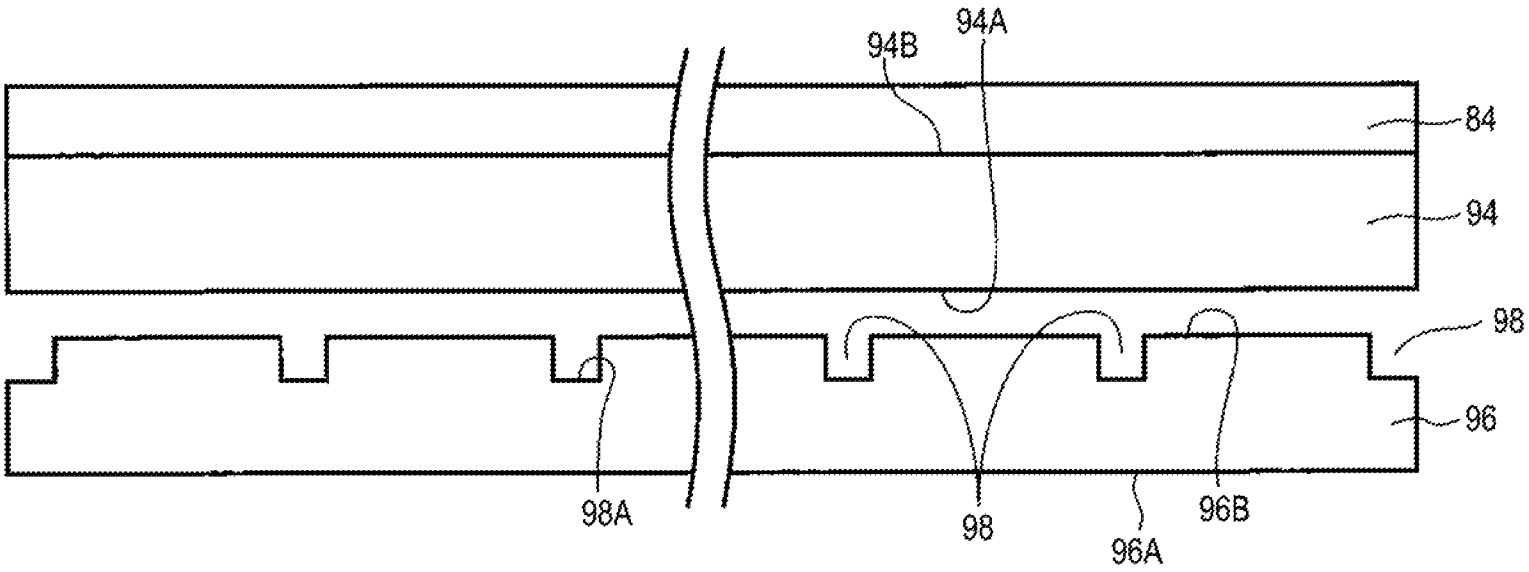
FIG. 4 is a schematic diagram corresponding to a cross section that is taken along line A-A in FIG. 3.

As illustrated in FIG. 4, in the second plate-shaped body 96, plural inner grooves 98 extending in the belt rotating direction D are formed at equal intervals in the external surface 96B of the second plate-shaped body 96 facing the inner surface 94A of the first plate-shaped body 94. The inner grooves 98 are formed through the entire length from the end on the upstream side U to the end of the second plate-shaped body 96 on the downstream side L and the inner grooves 98 are also formed in both edge portions of the second plate-shaped body 96 in the width direction.

The inner groove 98 is formed to have a rectangular shape in a cross section and a depth dimension of the inner groove 98 is set such that an interval distance between a bottom surface 98A of the inner groove 98 and the inner surface 94A of the first plate-shaped body 94 is set not to cause the capillary phenomenon in the lubricant 92.

Moreover, in the exemplary embodiment, a case where the inner grooves 98 are formed on the external surface 96B of the second plate-shaped body 96 is described, but the invention is not limited to the exemplary embodiment. For example, outer grooves are formed on the inner surface 94A of the first plate-shaped body 94 or the outer grooves are formed on the inner surface 94A of the first plate-shaped body 94 and the inner grooves 98 may be provided on the external surface 96B of the second plate-shaped body 96.

In addition, the inner groove 98 may not have the rectangular shape in the cross section and may have a V-shaped cross section or a U-shaped cross section.

An operation of the exemplary embodiment having the above configuration will be described. In the fixing device 60, if the fixing belt 84 is rotated, some of the lubricant 92 applied to the inner circumferential surface 84A of the fixing belt 84 is scraped off in the tip 94C of the first plate-shaped body 94 of the heating member 86 and is stored on the upstream side U of the first plate-shaped body 94.

In this case, the gap 97 is formed between the first plate-shaped body 94 and the second plate-shaped body 96 configuring the heating member 86, and it is possible to guide the lubricant 92 stored on the upstream side U of the first plate-shaped body 94 to the downstream side L via the gap 97 by the capillary phenomenon generated in the gap 97. Then, the lubricant 92 guided to the downstream side L along the gap 97 is returned to the inner circumferential surface 84A of the fixing belt 84 by the bent portion 96D of the second plate-shaped body 96.

As described above, the lubricant 92 that is scraped off on the upstream side U of the heating member 86 can be returned to the inner circumferential surface 84A of the fixing belt 84 on the downstream side L of the heating member 86. Then, it is possible to reduce a decrease in the lubricant 92 attaching to the inner circumferential surface 84A of the fixing belt 84.

Therefore, it is possible to suppress an increase in friction between the heating member 86 and the fixing belt 84 and to suppress an increase in rotation torque compared to a case where the lubricant 92 scraped off from the inner circumferential surface 84A of the fixing belt 84 cannot be returned to the inner circumferential surface 84A of the fixing belt 84.

In this case, the plural inner grooves 98 extending in the belt rotating direction D are formed on the external surface 96B of the second plate-shaped body 96. Thus, it is possible to suppress spreading of the lubricant 92, which is guided by the capillary phenomenon in the gap 97 between the first plate-shaped body 94 and the second plate-shaped body 96, in the width direction by the inner grooves 98. Therefore, the movement of the lubricant 92 delivered between the first plate-shaped body 94 and the second plate-shaped body 96 is facilitated in the belt rotating direction D.

Then, the interval distance between a bottom surface 98A of the inner groove 98 and the inner surface 94A of the first plate-shaped body 94 is set not to cause the capillary phenomenon in the lubricant 92. Therefore, it is possible to suppress coming and going of the lubricant 92 on both sides of which a border is the inner grooves 98 and the movement of the lubricant 92 in the belt rotating direction D is facilitated compared to a case where the inner grooves 98 are not provided.

In addition, the inner grooves 98 are also formed in both edge portions of the second plate-shaped body 96 in the width direction. Therefore, leakage of the lubricant 92 on the side of the heating member 86 is suppressed.

Figure 5:
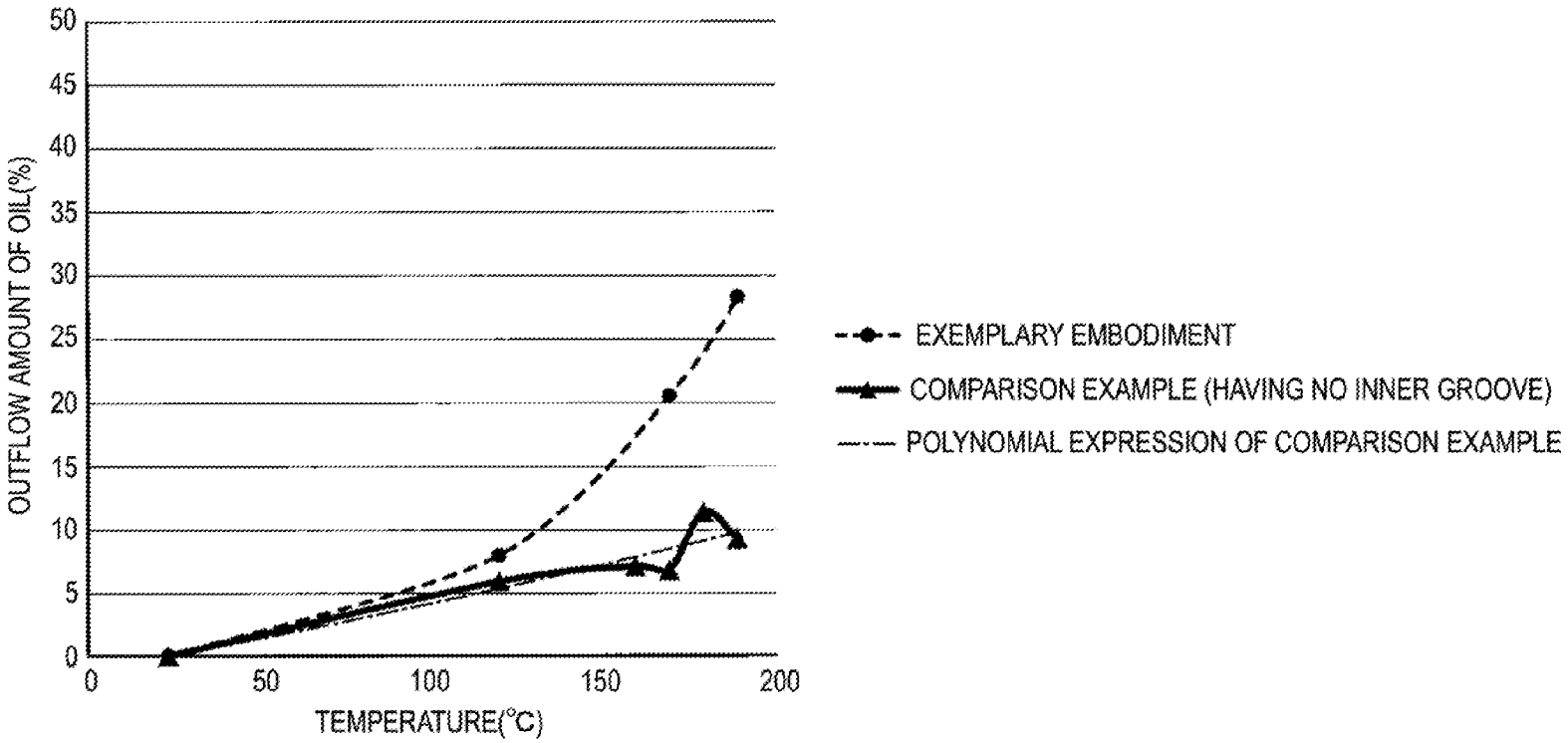
FIG. 5 is a graph illustrating an outflow amount of oil with respect, to a temperature.

Here, FIG. 5 illustrates a test result indicating an effect of the inner grooves 98 provided in the second plate-shaped body 96 and illustrates an outflow amount of oil with respect to a temperature.

In this test, the lubricant 92 is supplied on the upstream side U of the heating member 86, the heating member 86 is maintained at a predetermined temperature and then is left standing for 1 hour. Thereafter, the outflow amount of the lubricant 92 which flows out from the downstream side L of the heating member 86 is measured and a ratio to a supply amount is illustrated. A broken line in the figure indicates a test result of the exemplary embodiment having the inner grooves 98 in the second plate-shaped body 96 and a solid line in the figure includes a test result of a comparative example which does not have the inner grooves 98 in the second plate-shaped body 96.

In the exemplary embodiment in which the inner grooves 98 are formed in the second plate-shaped body 96, the outflow amount of the lubricant 92 is increased compared to the comparative example. Particularly, the effect is remarkable at 200° C. or less that is a heating temperature of the fixing belt 84 by the heating member 86.

Moreover, in the exemplary embodiment, a case where the interval distance between the bottom surface 98A of the inner groove 98 and the inner surface 94A of the first plate-shaped body 94 is set not to cause the capillary phenomenon in the lubricant 92. However, if the inner grooves 98 are formed, it is possible to suppress the operation of the capillary phenomenon compared to a case where the inner grooves 98 are not formed. Therefore, it is possible to obtain a certain effect for guiding the lubricant 92 in the belt rotating direction D.

In addition, in the exemplary embodiment, the inner grooves 98 are formed over the entire length from the end on the upstream side U to the end of the second plate-shaped body 96 on the downstream side L. However, even if the inner grooves 98 are partially provided in the second plate-shaped body 96, it is possible to obtain a certain effect for guiding the lubricant 92 in the belt rotating direction D.

On the other hand, in the second plate-shaped body 96, the extended-out portion 96C, which is extended outward on the upstream side U from the tip 94C of the first plate-shaped body 94 on the upstream side U, is formed in the tip portion on the upstream side U in the belt rotating direction D. Therefore, it is possible to guide the lubricant 92 accumulated on the upstream side U of the first plate-shaped body 94 to the gap 97 between the first plate-shaped body 94 and the second plate-shaped body 96.

In addition, it is possible to suppress wraparound of the lubricant 92 on an inner surface 96A side of the second plate-shaped body 96 by the extended-out portion 96C.

Then, in the image forming apparatus 100 having such a fixing device 60, it is possible to suppress an increase in friction between the heating member 86 and the fixing belt 84 due to a decrease of the lubricant 92, and an increase in the rotation torque accordingly. Therefore, it is possible to reduce maintenance and management of replenishment and the like of the lubricant 92.

Second Exemplary Embodiment

Figure 6:
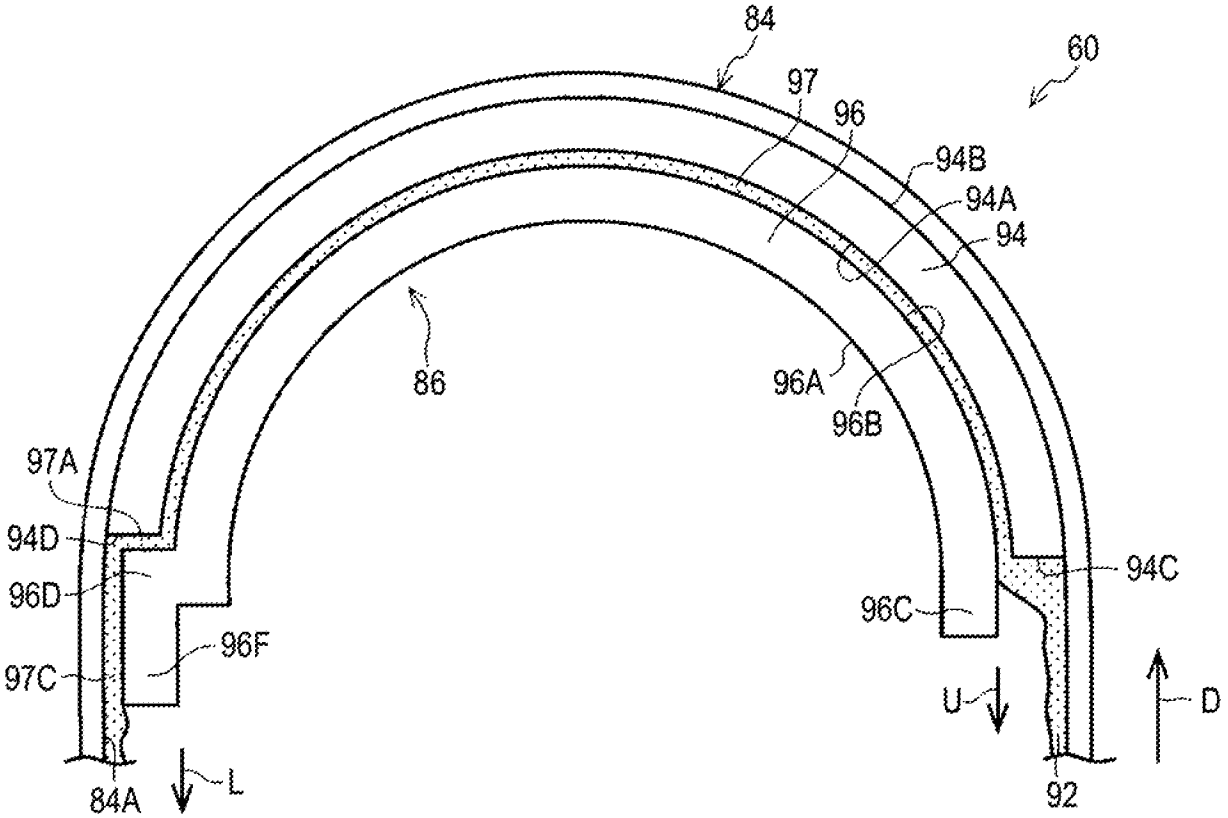
FIG. 6 is a view illustrating a fixing device according to a second exemplary embodiment and an enlarged view corresponding to a main portion of FIG. 2.

FIG. 6 is a view illustrating a second exemplary embodiment and the same reference numerals are given to the same or equivalent portions as those of the first exemplary embodiment, the description thereof will not be repeated, and only different portions will be described.

That is, an extension portion 96F extending on the downstream side L is formed along an inner circumferential surface 84A of a fixing belt 84 from a tip portion of a bent portion 96D in a second plate-shaped body 96 of a heating member 86. Dimensions of a gap 97C between the extension portion 96F and the inner circumferential surface 84A of the fixing belt 84 is set to substantially the same dimensions as a gap 97 between a first plate-shaped body 94 and the second plate-shaped body 96.

It is possible to uniformly level the lubricant 92 returning to the inner circumferential surface 84A of the fixing belt 84 in the bent portion 96D of the second plate-shaped body 96 by the extension portion 96F extending along the inner circumferential surface 84A with such a configuration compared to a case where the extension portion 96F is not provided.

Moreover, in each of the exemplary embodiments, a case where the first plate-shaped body 94 and the second plate-shaped body 96 disposed on the inner side of the fixing belt configure the planar heating member 86 is described, but the invention is not limited to the exemplary embodiments. For example, it is possible to use the fixing belt 84 in a fixing device of an electromagnetic induction heating type.

Third Exemplary Embodiment

Figure 7:
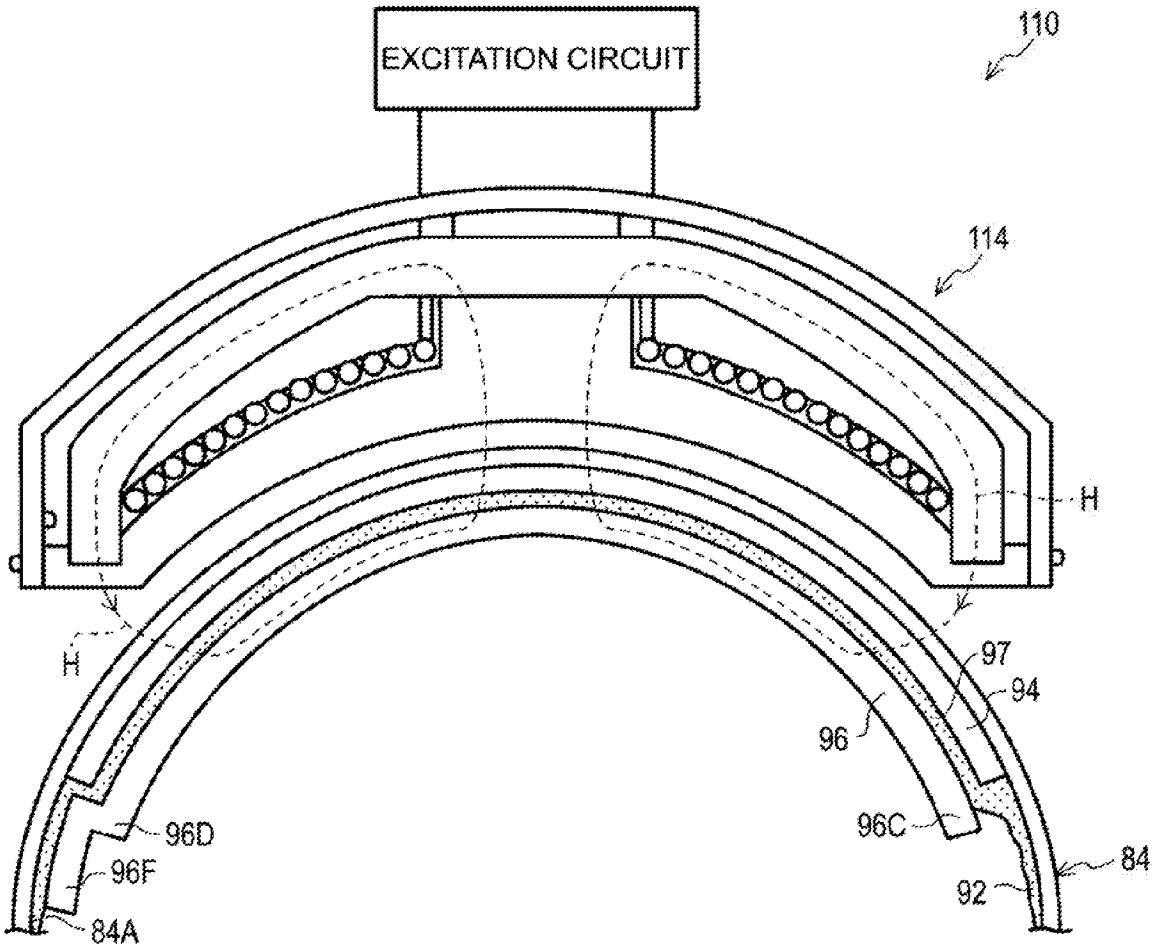
FIG. 7 is an enlarged view illustrating a main portion of a fixing device according to a third exemplary embodiment.

That is, FIG. 7 is a view illustrating a third exemplary embodiment and a fixing device 110 that performs electromagnetic induction heating to a fixing belt 84 is illustrated. In the exemplary embodiment, the same reference numerals are given to the same or equivalent portions as those of the first and second exemplary embodiments, the description thereof will not be repeated, and only different portions will be described.

The fixing device 110 includes an IH heater 114 that performs electromagnetic induction heating to an AC magnetic field conductive layer provided in a fixing belt 84. A first plate-shaped body 94 provided on an inside of the fixing belt 84 forms a magnetic path of an AC magnetic field generated by the IH heater 114 and includes a temperature-sensitive magnetic member that is electromagnetic-induction heated.

In addition, a second plate-shaped body 96, which is provided in the first plate-shaped body 94 via a gap 97, induces magnetic force lines H passing through the first plate-shaped body 94 and includes a guide member for diffusing heat generated by the first plate-shaped body 94.

It is possible to obtain the same function and effect as those described above even with such a configuration.

Moreover, in each exemplary embodiment, a case where the first plate-shaped body 94 includes the planar heat generating element or the temperature-sensitive magnetic member, and the second plate-shaped body 96 includes the heat conductive member or the guide member is described, but the invention is not limited to the exemplary embodiments. It is possible to obtain the effects described above as long as it is a member that is disposed on the inside of the fixing belt 84 where the lubricant 92 is applied to the inner circumferential surface 84A.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

an endless fixing belt that has an inner circumferential surface to which lubricant is applied and that is rotated;

a first plate-shaped body that is disposed along the inner circumferential surface and is in contact with the inner circumferential surface;

a second plate-shaped body that is disposed along the first plate-shaped body at a distance that causes a capillary phenomenon in the lubricant; and a bent portion that is provided on a downstream side end portion of the second plate-shaped body in a rotating direction of the fixing belt and is bent on an inner circumferential surface side of the endless fixing belt and is on a downstream side of an end portion of the first plate-shaped body in the rotating direction of the fixing belt.

2. The fixing device according to claim 1, further comprising an extension portion that extends along the inner circumferential surface from a tip portion of the bent portion.

3. The fixing device according to claim 1, wherein a plurality of grooves extending in the rotating direction of the fixing belt are formed on at least one facing surface of the first plate-shaped body and the second plate-shaped body facing each other.

4. The fixing device according to claim 1, further comprising an extended-out portion that is provided in the end portion on an upstream side of the second plate-shaped body and is extended outward on the upstream side of the end portion of the first plate-shaped body.

5. An image forming apparatus comprising:

a forming portion that forms an image on a medium; and the fixing device according to claim 1.

* * * * *